United States Patent [19]

Terry

[11] 4,093,058

[45] June 6, 1978

[54] COIN OPERATED NEWSPAPER VENDING MACHINE

[75] Inventor: Charles D. Terry, Palestine, Tex.

[73] Assignee: Terry Manufacturing Company, Palestine, Tex.

[21] Appl. No.: 782,960

[22] Filed: Mar. 30, 1977

[51] Int. Cl.[2] ..... G07F 5/08

[52] U.S. Cl. ..... 194/71

[58] Field of Search ..... 194/71, 88, 92, 91, 194/93, 1 G

[56] References Cited

FOREIGN PATENT DOCUMENTS 855,502 11/1970 Canada ..... 194/93

*Primary Examiner*—Stanley H. Tollberg

[57] ABSTRACT

An improved and simplified coin operated mechanism for newspaper dispensers and the like includes a more secure and reliable latch which operates in conjunction with a column of coins of the required denominations in a mode counter to the prior art for the sake of greater reliability and simplicity. Latch retainer pins, subject to gradual wear, are made easily replaceable on the mounting bracket. Counterweighted pawls, which must accurately gage the heights of required coin combinations, have an improved mounting and adjusting arrangement on the mechanism whereby the parts can be quickly disassembled and reassembled and adjusted on the mechanism for accuracy of operation. The invention additionally possesses an improved and simplified Sunday paper lock out and release device and an improved coin release and return mechanism for improper or defective coins including a unique anti-cheat feature.

16 Claims, 13 Drawing Figures

FIG. 1
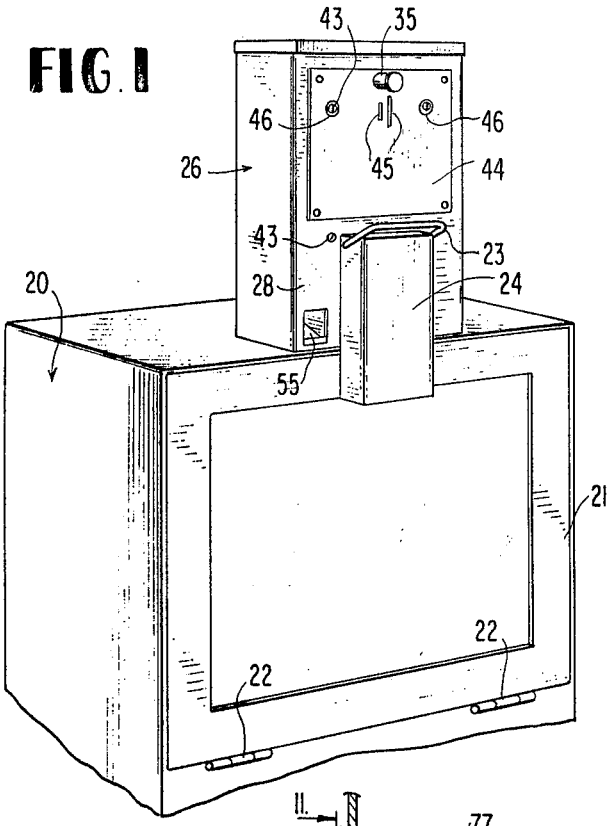
FIG. 12
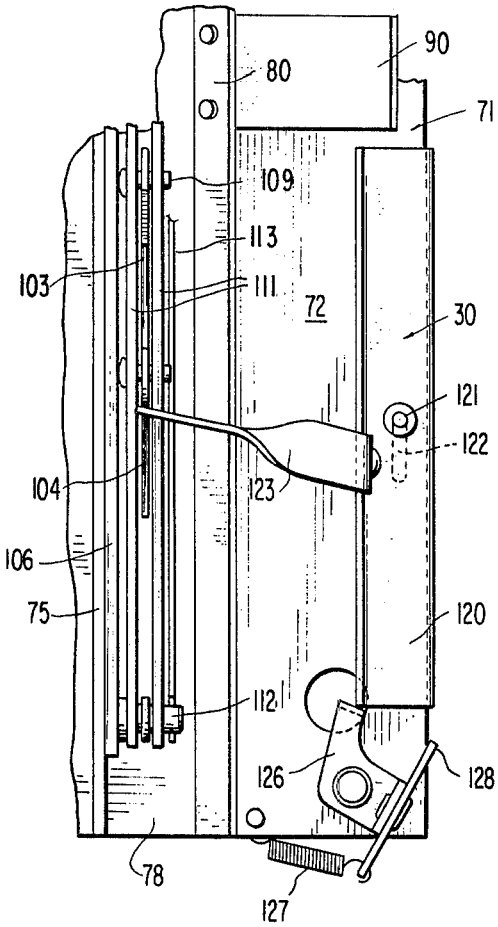
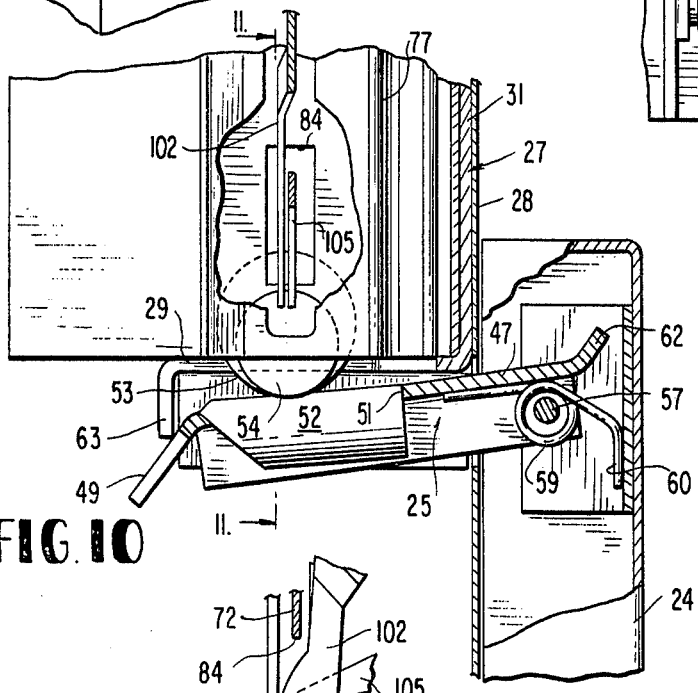
FIG. 10
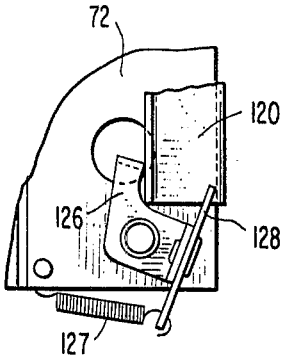
FIG. 12A
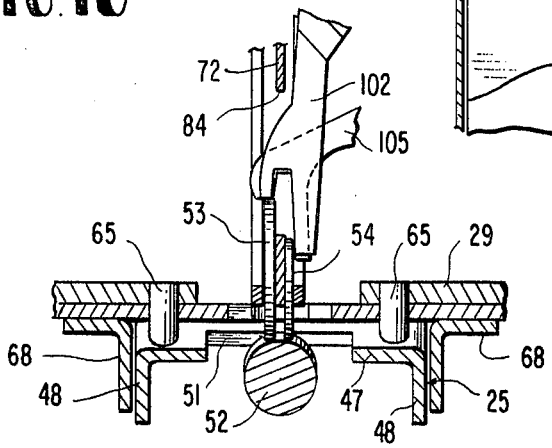
FIG. 11

FIG. 7
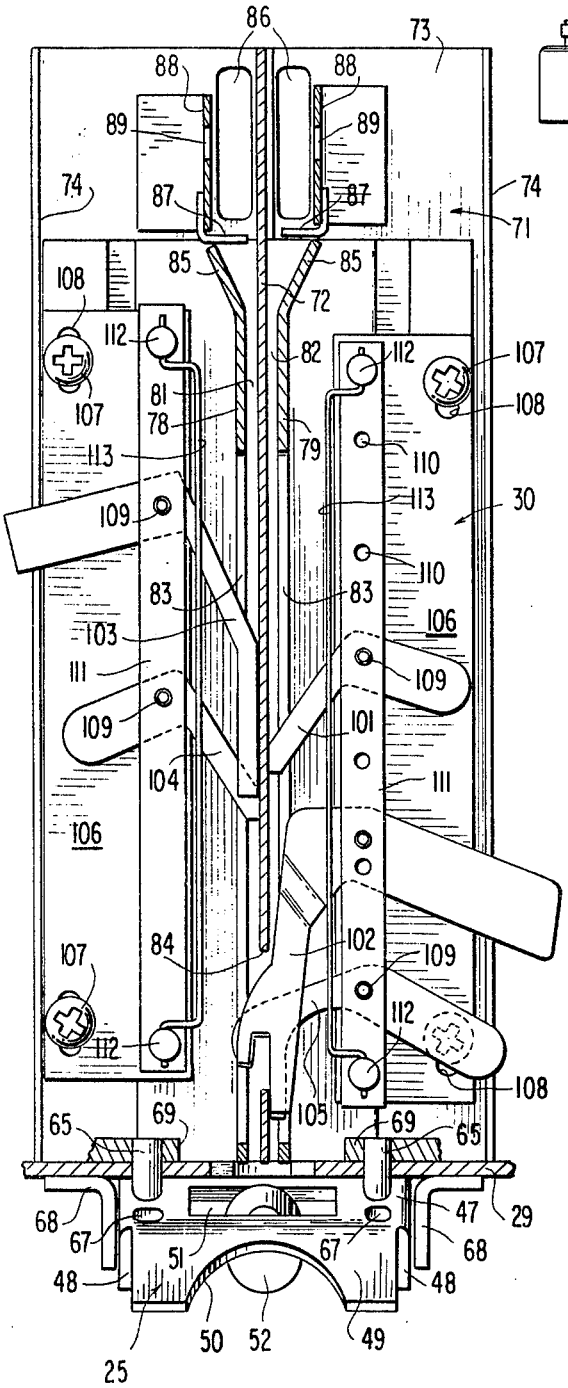
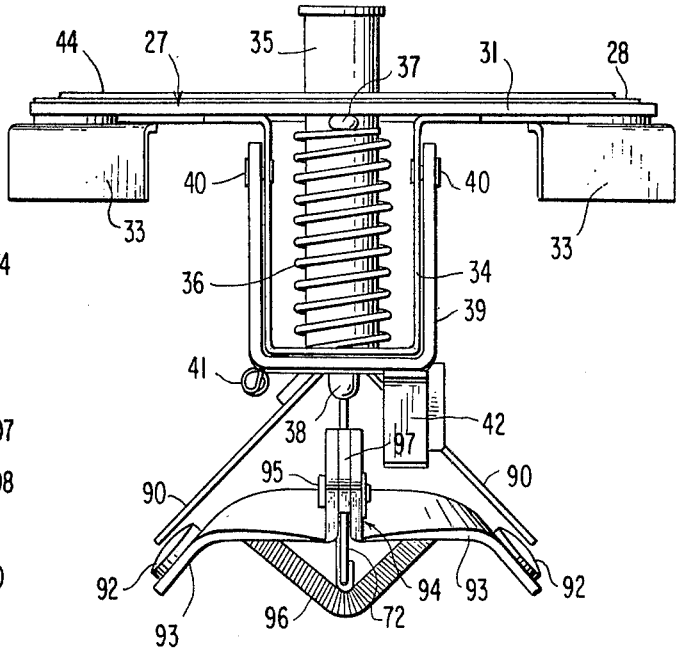
FIG. 3
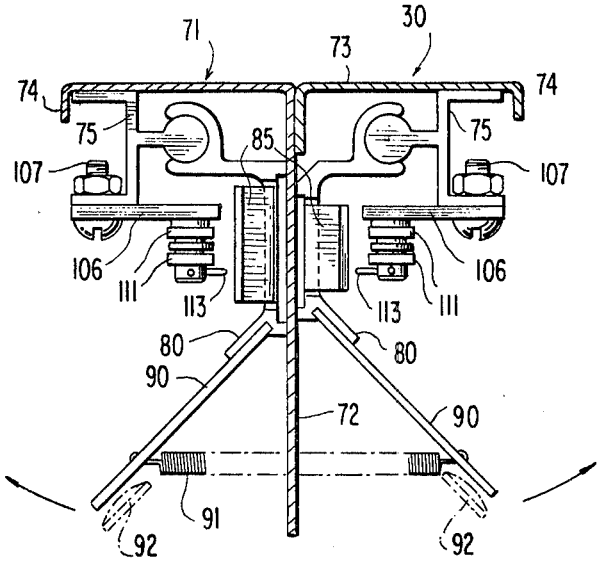
FIG. 4

COIN OPERATED NEWSPAPER VENDING MACHINE

BACKGROUND OF THE INVENTION

Coin operated newspaper vending machines and coin controlled mechanisms for such machines are well known in the prior art. Some examples of the patented prior art are contained in U.S. Pat. Nos. 3,174,608; 3,265,177; 3,403,765; 3,464,530; 3,760,923 and 3,804,223.

Despite a fairly sophisticated state of the art, there remains a need for a more economical and more rugged and durable coin mechanism for newspaper dispensers which will be reliable in operation in the harsh environment and under the rough treatment encountered by such machines.

The present invention has for its objective to satisfy this need in the art by providing a coin operated mechanism for newspaper vending machines having a number of important improvement features over the prior art. More particularly, the invention provides a mechanism having three major sub-assemblies namely, a coin mechanism mounting bracket, a coacting newspaper access door latch of improved construction and mode of operation, and a greatly improved coin operated mechanism which can be easily and quickly installed on or removed from the mounting bracket, and which mechanism possesses a number of operational improvements in addition to its overall structural integrity and simplicity. These three major components or sub-assemblies in the invention collectively contribute to better and more reliable performance in the overall operation of the dispenser, minimized maintenance costs and reliability of operation in the field which is paramount to the success of any vending machine.

Among the specific features which the invention possesses are:

(1) Accurate and reliable gaging and detection of desirable combinations of coins necessary to effect release of the latch so that the access door can be pulled open by a customer.

(2) The provision of a fool-proof and simple release and return system for improper or defective coins and foreign material.

(3) Simplified and reliable mechanism for quickly converting the system for operation with either of two price combinations of coins, as for daily and Sunday newspapers.

(4) The coin mechanism is a preassembled and preadjusted sturdy unit which can be quickly and easily installed on the mounting bracket.

(5) The provision of an overall arrangement whereby the critical relationship of the access door latch to its keeper means on the mounting bracket does not have to be altered or interfered with in the process of making a price change in the mechanism. Two very critical items in vending machines of this type are maintaining the proper relationship of the door latch to its keeper or catch points, and the proper mounting and adjustment of the coin height gaging pawls. The invention fully satisfies both of these critical points.

(6) The access door latch is constrained at all times and properly guided laterally so that a customer cannot twist the latch and release it improperly by tugging on the corners of the access door.

(7) The provision of fool-proof means for preventing a person from retrieving his purchase money through the coin return system as he also removes a newspaper from the dispenser.

(8) Providing an arrangement whereby the access door latch does not directly engage or catch on the coin mechanism but rather on a very sturdy part of the mounting bracket.

(9) The provision of easily replaceable catch or keeper pins for the door latch which does not require disturbing the entire mounting bracket.

(10) The provision of a greatly improved pawl mounting sub-assembly and adjusting system in the coin mechanism.

Other features and advantages of the invention will become apparent during the course of the following description.

BRIEF DESCRIPTION OF THE DRAWINGS

FIG. 1 is a fragmentary perspective view of a typical semi-honor newspaper vending machine on which the present invention is utilized.

FIG. 3 is a horizontal section taken on line 3—3 of FIG. 2.

FIG. 4 is a similar section taken on line 4—4 of FIG. 2.

FIG. 7 is a vertical section taken on line 7—7 of FIG. 6.

FIG. 10 is a fragmentary vertical section taken through the access door latch and associated parts showing the operation of the latch in relation to coins of a proper denomination held down by pawls in the coin tracks.

FIG. 11 is a fragmentary vertical section taken on line 11—11 of FIG. 10.

FIG. 12 is a fragmentary side elevational view taken on line 12—12 of FIG. 2.

FIG. 12A is a fragmentary side elevational view similar to FIG. 12 showing the release position of a spring loaded latch element for a Sunday paper lock out slide.

DETAILED DESCRIPTION

Figure 2:
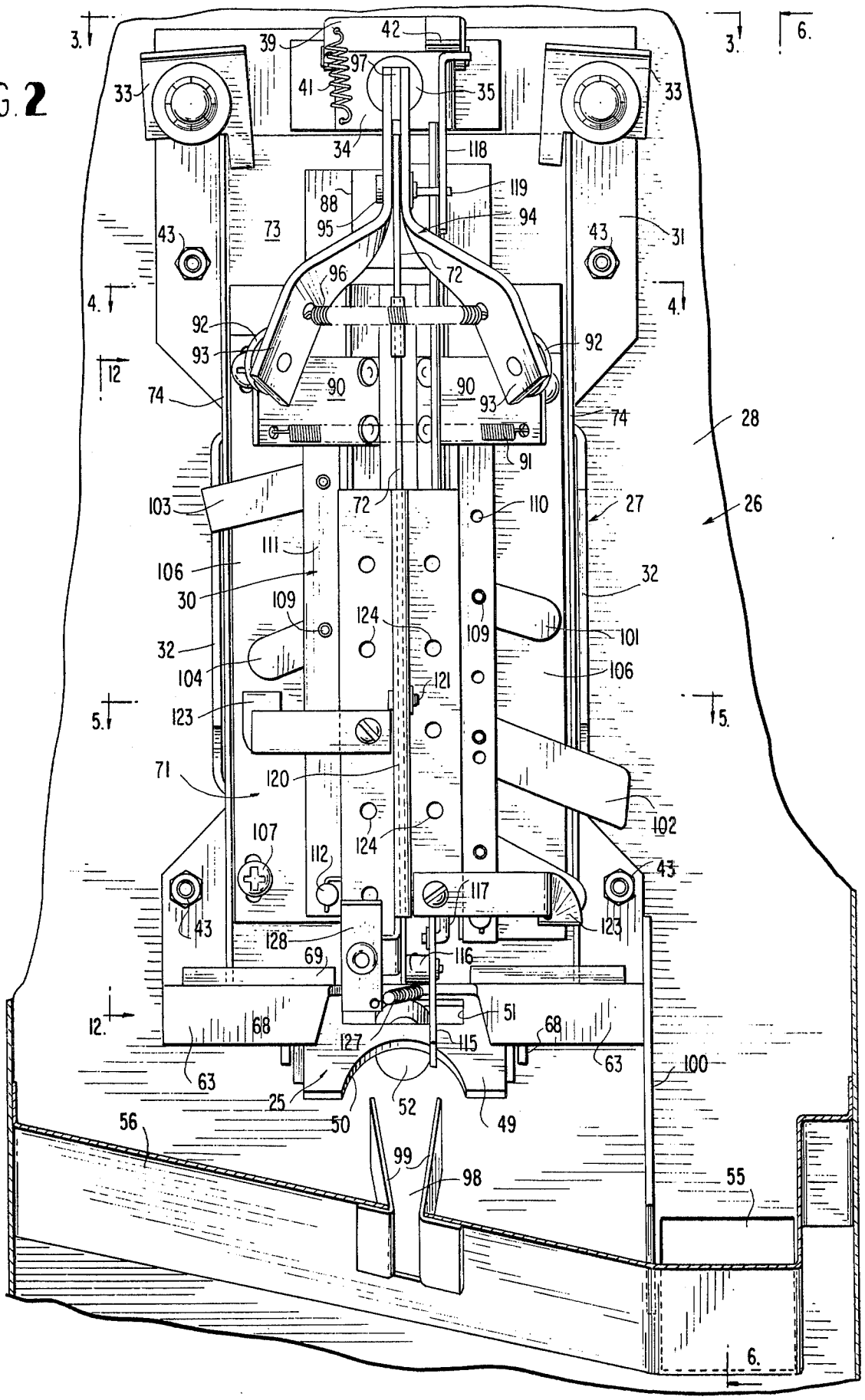
FIG. 2 is an enlarged front elevational view of the invention with the vending cabinet broken away and partly in section and looking toward the front wall of the vending cabinet.

In the drawings, the coin mechanism is adjusted to dispense daily newspapers in all of the figures except FIG. 12 where the mechanism is adjusted to dispense Sunday newspapers.

Referring to the drawings in detail wherein like numerals designate like parts, a conventional semi-honor newspaper dispensing cabinet 20 is shown in FIG. 1 having a front access door 21 hinged to the cabinet by horizontal access hinges 22. The access door 21 is equipped at its top with a customer pull handle 23 on an extension post 24 of the access door. An access door latch 25 constituting a very important element of the invention is carried by the door extension post 24 for cooperation with stationary latch keeper means inside of the coin mechanism housing 26 atop the cabinet 20 and securely fixed thereto.

A second major component of the invention comprises a very sturdy unitary coin mechanism mounting bracket 27 which attaches securely to the interior of the vertical front wall 28 of mechanism housing 26. A horizontal plate extension 29 on the lower end of the mounting bracket 27 carries the lateral guidance and catch or keeper means for the access door latch 25, as will be fully described.

The third major component of sub-assembly embodied in the invention is the improved coin operated mechanism 30 which is bodily supported on the mounting bracket 27 in a readily releasable manner, to be fully described.

The mounting bracket 27 comprises a flat vertical plate body 31 having a pair of spaced parallel side vertical locator flanges 32 for the lateral positioning and alignment of the mechanism assembly 30 on the mounting bracket 27. The lower horizontal plate extension 29 of the mounting bracket also forms a solid seat for the bottom of the assembly 30. A pair of pivoted keeper plates 33 near the top and opposite sides of the mounting bracket 27 serve to releasably secure the coin operated assembly 30 on the mounting bracket for quick and easy removal, when necessary, as when adjusting or changing the number and relationship of coin gaging pawls.

A horizontal U-shaped support and guide yoke 34 for a reciprocatory coin release plunger 35 is also rigidly secured to the plate body 31 of the mounting bracket near its top and at its transverse center. The operation of the plunger 35 and associated elements will be completely described. The plunger is biased to a retracted position where it projects forwardly of the housing front wall 28 by an expansible coil spring 36, FIG. 3, having one end bearing on the front of the yoke 34 and its opposite end engaging a cotter pin 37 carried by the plunger. The plunger has a reduced diameter rounded axial pin extension 38, for a purpose to be described.

A coin release plunger disabling bail 39 of U-shaped formation extends around the exterior of the yoke 34 and is pivotally secured to the side walls of the yoke at 40 for vertical swinging movement at proper times. The pivoted bail 39 is biased downwardly relative to the yoke 34 by a retractile spring 41 whose opposite ends are connected to the yoke 34 and bail 39 near a corner of the latter. When in the biased down level position, FIG. 9, the front of the bail 39 overlaps and blocks the forward end of the coin release plunger 35 immediately above its pin extension 38 so that the plunger is disabled and cannot be manually operated. This is an important anti-theft feature which prevents a customer from retrieving his coins while opening the access door 21 to take a newspaper following the deposit of a proper number of coins of correct denomination. The bail 39 has a forward actuator extension 42 by means of which the bail is raised automatically against the force of spring 41 at certain times by means yet to be described so that the plunger 35 is rendered operable by a customer.

The mounting bracket 27 is very securely attached to the housing front wall 28 by bolts 43 which are widely spaced for stability. The lower pair of bolts 43, FIG. 1, are below the usual indicia plate 44 which is detachably mounted with screws on the housing front wall 28. The plate 44 contains coin entrance slots 45, such as dime and quarter slots, and may require changing at intervals to accommodate different denominations of coins. To facilitate changing or removing the plate 44 without any disturbance of the mounting bracket 27, clearance openings 46 for the upper pair of bolts 43 are provided in the plate 44, FIG. 1.

As stated, an important and unique feature of the invention resides in the access door latch 25 and its operation in relation to the fixed mounting bracket 27 and the coin operated mechanism 30. The latch 25 is channel-like in cross section, FIG. 11, having a top wall 47 and side depending flanges 48. At its leading end away from the extension post 24, the latch 25 has an inclined flange 49 or camming part having a large arcuate recess 50. Centrally, the top wall 47 has a large rectangular cut-out 51 bridged fore and aft by a rigid longitudinal bar section 52 of circular cross section. The bar section 52 is preferably welded to the top wall 47 at the front and back edges of the cut-out 51. The bar section 52 is slightly inclined upwardly toward its leading end, FIG. 10, and projects slightly above the plane of the top wall 47 of the latch. As clearly shown in FIG. 11, the bar section 52 forms a transversely arcuate seat for the bottom edges of coins 53 and 54, such as a quarter and a dime when a Sunday paper is being purchased, as will be further described. The cut-out 51 forms slots for coins on opposite sides of the bar section 52 so that coins under some circumstances can pass around the bar section and through the cut-out of the latch 25 and be returned to the customer at a return opening 55, FIG. 1, in the bottom of housing 26 after sliding down an inclined wall 56 in the housing 26 beneath the coin mechanism 30 and mounting bracket 27, FIGS. 2 and 6.

The latch 25 is solidly mounted for vertical swinging about its rearward end on a transverse pivot shaft 57 having its ends supported by a sturdy apertured U-bracket 58 preferably bolted, or may be welded, to the interior of the extension post 24. The latch 25 is biased upwardly on its pivot by a torsion spring 59 having one arm 60 engaging the wall of bracket 58 and a second arm 61 engaging beneath the top wall 47. A stop extension 62 on the rear of pivoted latch 25 positively limits its upward movement to a position where the latch is approximately at right angles to the door extension post 24 due to contact of the element 62 with bracket 58.

Figure 9:
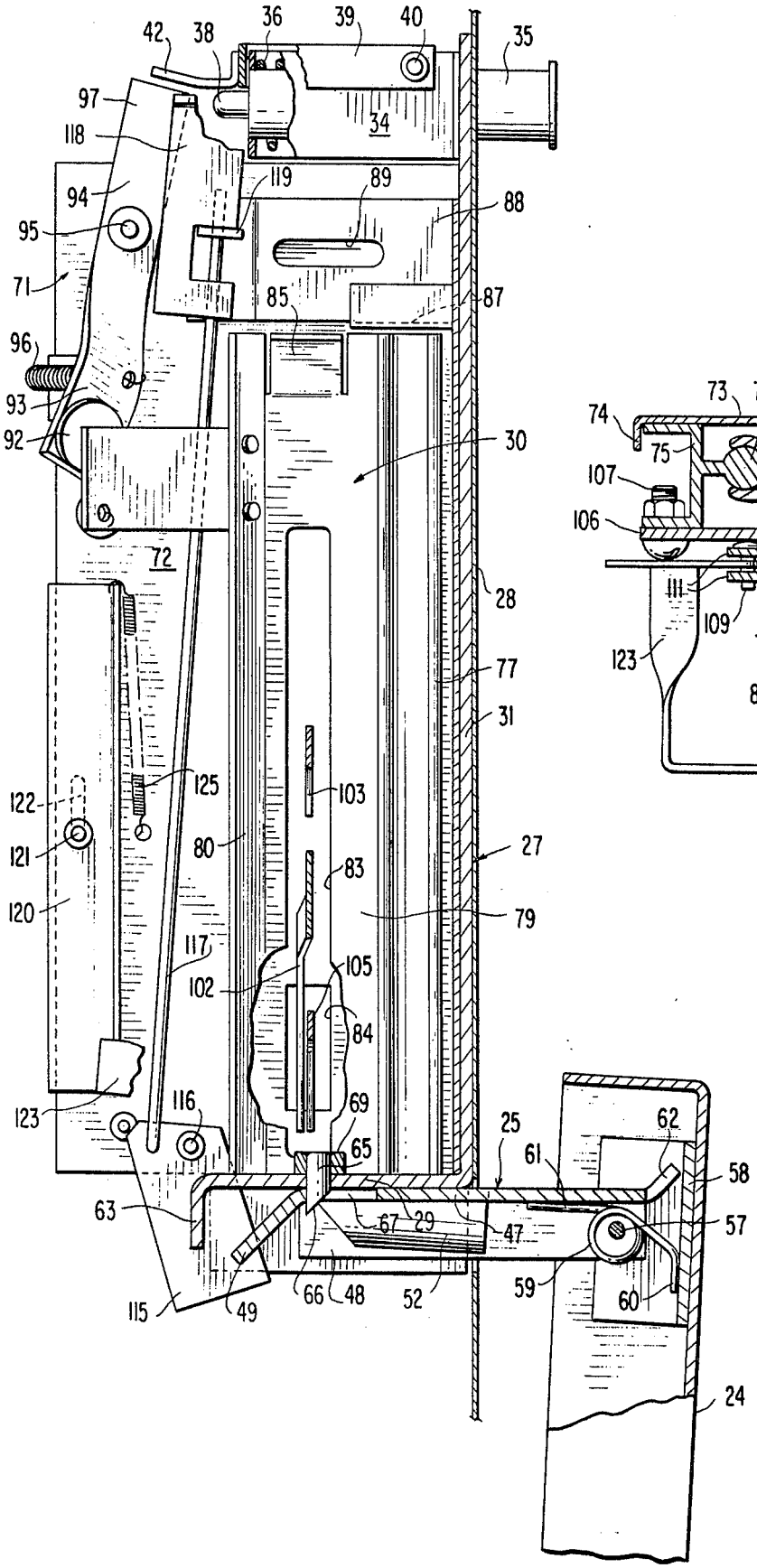
FIG. 9 is a view similar to FIG. 6 depicting the construction and operation of an automatic anti-cheat linkage which disables the coin return system.

The aforementioned lower horizontal plate extension 29 of main mounting bracket 27 has downturned vertical flanges 63 on opposite sides of a center cut-out 64 in the plate extension 29. As will be further discussed, when the access door 21 is closed, the inclined camming flange 49 engages the fixed flanges 63, FIGS. 2 and 10, and the latch 25 is depressed against the force of spring 59 and assumes the inclined position shown in FIG. 10 and also in FIG. 6 where the latch 25 is actually released from its keeper means. This is an important difference in the invention over the prior art resulting in a different mode of operation with increased reliability. The arrangement is such that the latch 25 is actually in a released condition due to the described camming arrangement when the door 21 and extension post 24 are fully closed and vertical. However, in the absence of proper coins in the tracks of the mechanism 30, yet to be described, the latch 25 will almost instantly assume a locking position such as shown in FIG. 9 if a person attempts to open the door 21 without coins. The door will crack open a very slight amount but insufficiently to allow removal of a newspaper or access to coins in the coin storage chamber of the housing 26 below the wall 56.

The positive holding or keeper means for the pivoted latch 25 comprises a pair of laterally spaced vertical short keeper pins 65 having beveled lower faces 66. The beveled faces 66 project below plate extension 29 in the path of movement of inclined flange 49 when the latch 25 is moving toward the locked position of FIG. 9. The flange 49 will cam under the beveled faces 66 of keeper pins 65 and these pins will enter elongated keeper slots 67 provided in the latch 25 on opposite sides of the cut-out 51. The spring 59 will urge the pivoted latch upwardly to interlock positively with the keeper pins 65 through the slots 67 so that the access door 21 cannot be pulled open.

Another improvement feature of the invention resides in a very stable lateral guidance means for the pivoted latch 25. This means comprises a pair of spaced parallel rigid guide rails 68, FIG. 11, formed by a pair of angle bars fixed to the bottom of horizontal plate extension 29. The passageway for the latch 25 formed by the rails 68 assures proper alignment and hence proper locking of the latch by keeper pins 65 even when someone is attempting to twist the access door in order to gain entry to the dispenser.

Figure 8:
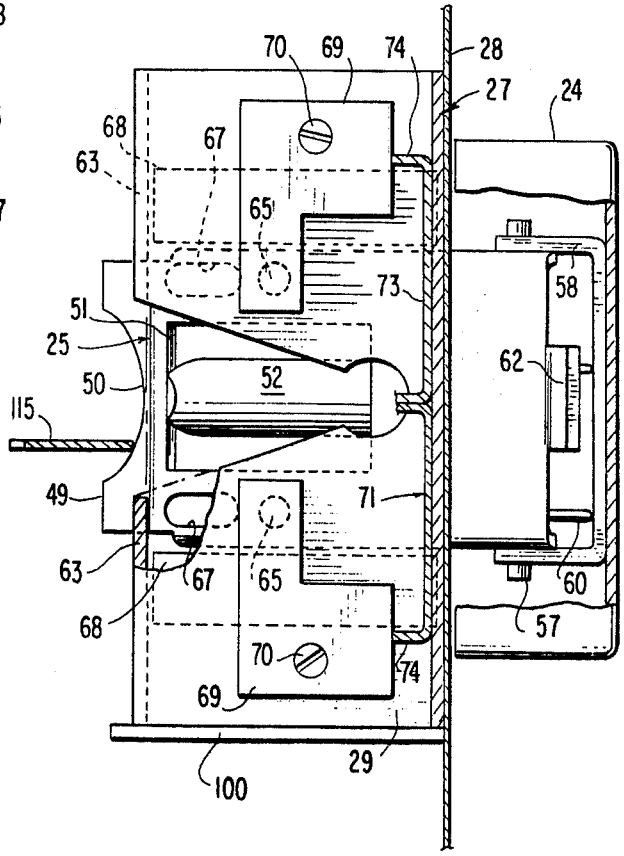
FIG. 8 is a horizontal section taken on line 8—8 of FIG. 6.

Since the keeper pins 65 are subject to appreciable wear, they are made readily replaceable without disturbing any other parts by having the keeper pins fixed to a pair of mounting plates 69 which are secured by bolts 70, FIG. 8, to the horizontal plate extension 29 of mounting bracket 27, the plate extension 29 also being apertured to allow the keeper pins 65 to project through it. The arrangement is very simple and allows the keeper pins to be quickly replaced whenever necessary.

The previously-mentioned coin operated mechanism assembly 30 possesses a number of improvement features over the prior art. It has been simplified for ease of assembly and adjustment as well as ease of installation as a unit on and removal from the mounting bracket 27.

The coin mechanism assembly 30 comprises a backbone or body member 71 of T-cross section, FIG. 4, which member forms the basic support for all parts of the assembly 30. The T-cross section body member 71 has a center vertical web 72 forming the common divider wall between two vertical coin passages, to be further described. The center web 72 is fixedly secured to a right angular vertical web 73 having longitudinal edge flanges 74 for added rigidity. The parallel flanges 74 fit snugly between the two locator flanges 32 of the mounting bracket 27. The cross web 73 of the T-cross section body member 71 lies flat against the plate body 31 of the mounting bracket in the assembly, and the pivoted keeper plates 33 engage over the top edge of the cross web 73 to secure the assembly 30 while the lower edge of the web 73 rests solidly on the horizontal plate extension 29 of the mounting bracket 27. By releasing the pivoted keeper plates 33, the entire assembly 30 can be lifted out of the mounting bracket 27 for adjustment or repair or for replacement by a different coin mechanism assembly having a different arrangement of coin gaging pawls. This constitutes one of the main convenience features of the invention. Proper alignment or squareness of the assembly 30 on the mounting bracket 27 is assured by the coaction of the locator flanges 32, the pivoted keepers 33 and the engagement of the lower edge of the web 73 on the horizontal plate extension 29. The two side vertical flanges 74 of the backbone 71, FIG. 8, also engage rearwardly of the two fixed plates 69 and between these plates and the vertical plate body 31. Thus, the lower end of the removable assembly 30 is also securely retained on the mounting bracket 27.

Figure 5:
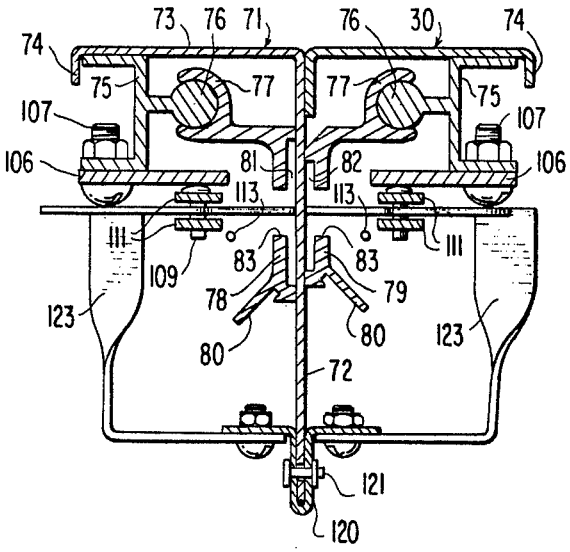
FIG. 5 is a similar section taken on line 5—5 of FIG. 2.

The assembly 30 additionally comprises a pair of spaced back-to-back parallel vertical channel members 75, preferably extruded, and rigidly attached to the vertical web 73 immediately inwardly of side flanges 74. These two channel members 75 extend vertically for a major portion of the two height of the T-cross section backbone or body member 71 in the assembly 30. On their inner sides, the members 75 carry integral longitudinal circular cross section bearing elements 76 which are engaged rotationally by coextensive extruded curved knuckles 77 forming parts of elongated straight coin tracks 78 and 79 having front longitudinal divergent flanges 80, FIGS. 4 and 5. The coin tracks 78 and 79 are pivotal around the vertical axes of the bearing elements 76 and these tracks form with the intervening flat web 72 of the backbone 71 vertical coin passages 81 and 82 for coins of different denominations such as quarters and nickels in the passage 81 and dimes in the smaller passage 82. The walls of coin tracks 78 and 79 are longitudinally slotted at 83 throughout most of their lengths, for a purpose to be described. The central web 72 is also slotted at 84, FIG. 9, near its lower end to accommodate certain coin gaging pawls, yet to be described.

The vertical coin passages 81 and 82 are open from top-to-bottom and at the tops of these passages divergent ramps 85 on the tracks 78 and 79 serve to funnel coins into the vertical passages 81 and 82 after the coins have been deposited through the slots 45, FIG. 1, and have passed through openings 86 in the top portion of the web 73 immediately behind the slots 45. The mounting bracket 27 also has a window or cut-out between the slots 45 and openings 86 to allow passage of the coins. Upon entering through the openings 86, the coins encounter support flanges 87, FIG. 7, to aid in delivering them to the tops of the passages 81 and 82. In this region, the coins also pass between the vertical web 72 and a pair of guide plates 88 immediately above the tops of the ramp elements 85 so that it is impossible for the coins not to be guided into the respective vertical passages 81 and 82 when they are deposited through the slots 45.

Figure 6:
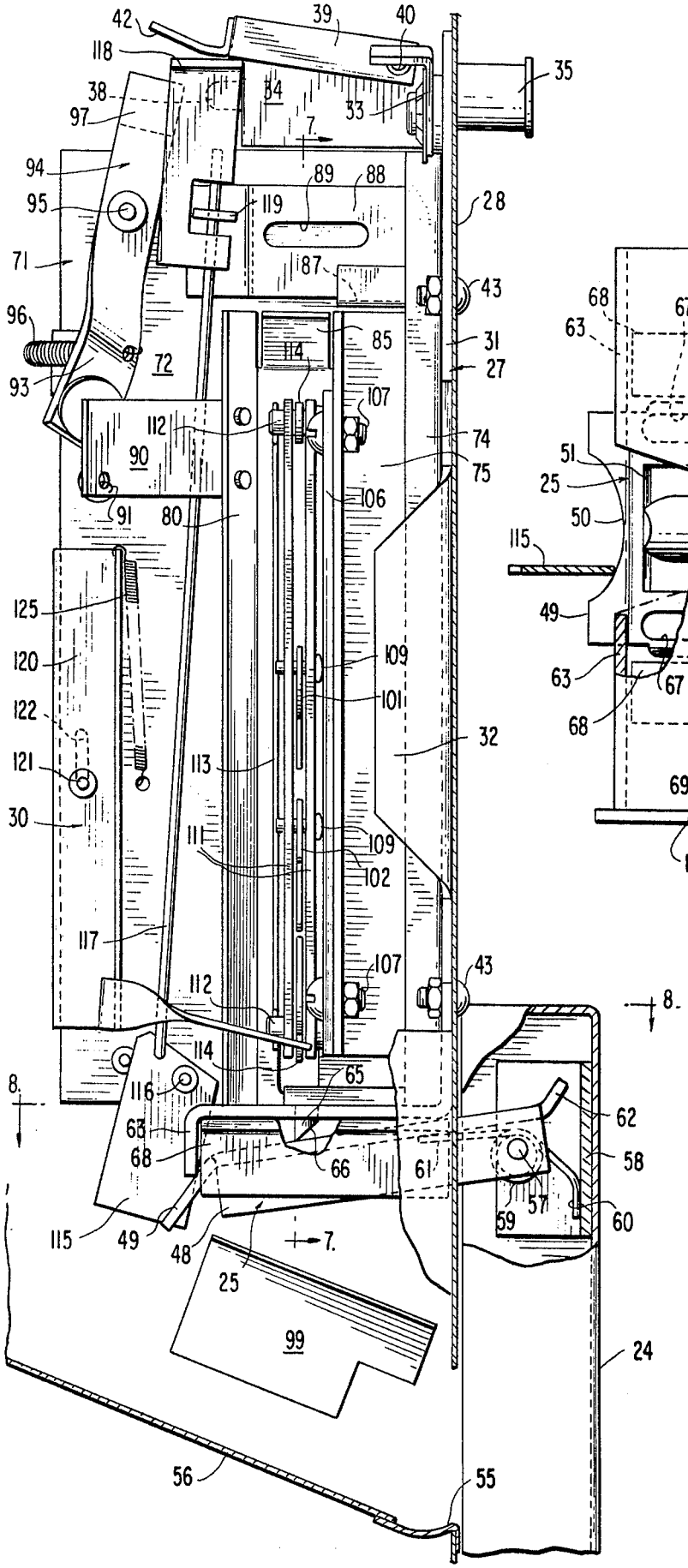
FIG. 6 is a vertical section taken on line 6—6 of FIG. 2.

The guide plates 88 also have horizontal slots 89, FIG. 6, through which maintenance personnel can introduce coins conveniently from inside of the cabinet 26 when servicing the mechanism. Relative longitudinal movements between the elements 76 and 77 are restrained while allowing free relative rotation at proper times to release coins from the slots 81 and 82. The relative longitudinal movements are prevented by internal keying means, not shown, engaging the elements 86 and 87 and being of a conventional nature.

Near and below their upper ends, the two coin tracks 78 and 79 carry divergent wing plates 90 attached to the flanges 80 and these wing plates are biased together by a retractile spring 91. At proper times, the interior faces of wing plates 90 are engaged cammingly by buttons 92 of low friction material on the lower end portions 93 of a wishbone lever 94, pivoted at 95 to the vertical web 72 of backbone 71. The lower end of wishbone lever 94 is biased forwardly or away from the cross web 73 by a spring 96 which engages about the edge of the vertical web 72, FIG. 3.

The wishbone lever 94 swings in a vertical plane and its top end portion 97 lies in the path of movement of the pin extension 38 of coin release plunger 35. Thus, when the plunger 35 is pushed inwardly by a customer against the action of spring 36, the rounded pin extension 38 will engage the rear side of wishbone lever 97 and swing it on its pivot 95 against the action of spring 96 which will then stretch. The camming buttons 92 will then engage the wing plates 90 and spread or separate them, the spring 91 stretching to permit this action. The coin tracks 78 and 79 will then pivot open and separate around the axes of elements 76 and faulty coins or coins of the wrong denomination will be released by gravity from the passages 81 and 82. Such coins will pass around one side or the other of the circular cross section bar 52 and will fall freely on the inclined wall 56 for return to the customer at 55.

It may be noted here that when coins of the proper denomination to purchase a newspaper are deposited through the slots 45 and pass through the coin passages 81 and 82 and are held against upward movement by gaging pawls, to be described, while resting on the bar section 52, FIGS. 10 and 11, such proper coins following retraction of the latch 25 will fall into a coin collection slot 98 formed by two plate members 99 on the inclined web 56, and will be delivered to the usual coin collection chamber in the housing 26 below the web 56. A vertical side wall extension 100 on the horizontal plate extension 29 of mounting bracket 27 precludes access by the fingers or instruments to the pivoted latch 25 or to coins in the collection chamber through the opening 55.

A significant feature of the assembly 30 is the provision thereon of an improved mounting and adjusting means for the customary counterweighted coin gaging pawls 101, 102, 103, 104 and 105. The purpose of these pawls is well known in the art and various arrangements of pawls are resorted to in mechanisms of this general character to gage the heights of coins or stacks of coins in the vertical passages 81 and 82. When coins of proper denominations are inserted into the dispenser and fall through the passages 81 and 82, various combinations of nickels, dimes and quarters to make up the correct price for a newspaper, such as a Sunday paper, are detected by various ones of the pawls. In essence, the counterweighted pawls gage the heights of coins or stacked columns of coins in the vertical passages 81 and 82 and coin arrays of the proper denomination in one or both passages 81 and 82 are prevented by the action of pawls from rising upwardly in the passages. In other words, such proper coins are held down rigidly by the pawls against upward displacement, for example, as illustrated for the two coins 54 and 53 in FIGS. 10 and 11. In such case, the inability of coins to move upwardly from their positions of rest on the bar section 52 cause the latch 25 to remain tilted as in FIG. 10 and free of engagement with the keeper pins 65 so that the access door 21 can be opened and a newspaper can be removed by the customer. When this occurs, the correct coins 53 and 54, or any other proper array of coins, will fall vertically into the collection slot 98 as soon as the latch 25 is retracted by the act of opening the access door. As previously stated, this mode of operation involving the latch 25 is a departure from the prior art wherein the latch is usually positively locked initially and is provided with a hump on its top which rides under the held coins and depresses and releases the latch. In this invention, the latch 35 is initially released and held in the depressed or inclined position by the proper coins to assure that the access door will open freely if the proper coins have been deposited. If not, and if the coins can move upwardly in the passages 81 and 82, the door will not open and the spring 59 will move the latch 25 to the positively latched position of FIG. 9 when the access door 21 is pulled toward the open position. The improved latch arrangement is more reliable than the prior art arrangements. Whenever the door 21 is closed, the camming action of the elements 49 and 63 assures a precise resetting of the latch 25 at the initial or starting position. It should be understood that the access door 21 is truly locked as where no coins are deposited because an opening pull on the door handle 23 can only move the door to the slightly cracked position of FIG. 9 where it is securely locked. The door closing spring, not shown, will always return the door and the latch 25 to the normal position shown in FIG. 10.

The conventional counterweighted and pivoted coin gaging pawls 101 through 105 can be employed in various combinations on the assembly 30 depending on newspaper prices and whether Sunday or daily or both types of newspapers are being sold in the dispenser. As stated, the pawls per se are conventional and they need not be described per se in greater detail. Suffice it to say that some counterweighted pawls, such as the pawls 101, 103 and 104 having their coin gaging terminals on one side only of the divider web 72, while other pawls, such as the pawls 102 and 105 may have their gaging terminals on both sides of the center web and projecting through the slot 84, as illustrated. The two slots 83 in the tracks 78 and 79 will accommodate all of the pawls.

The above-mentioned improved and simplified mounting and adjusting means for coin gaging pawls in the invention comprises a pair of vertical base plates 106 substantially coextensive lengthwise with the channel members 75 and bolted to the forward sides of the members 75 by bolts 107. The base plates 106 thus lie on opposite sides of the hinged coin tracks 78 and 79 and do not interfere with the movements thereof under influence of the wishbone lever 97 and associated parts. The base plates 106 have elongated adjusting slots 108 receiving the bolts 107, whereby the pawl assemblies which are bodily mounted on the base plates 106 can be adjusted upwardly or downwardly on the assembly 30 for accuracy and locked securely in the selected adjusted positions.

The counterweighted pawls 101 through 105 are freely suspended on horizontal pivot pins 109 which extend through accurately spaced prepunched apertures 110 in closely spaced pairs of elongated equal length pawl mounting bars or plates 111. In the assembly, the pawls are sandwiched in between the bars 111 of the pairs, FIG. 12, and near their opposite ends, the pairs of bars 111 are apertured to receive therethrough locator studs 112 which project from the base plates 106 and are attached thereto. Each pair of pawl mounting plates 111 is maintained connected to its base plate 106 by a double-ended wire securing element 113 which is readily removable from through apertures provided in the studs 112 at desired times when the pawls require changing or rearrangement. The pivot elements 109 for the pawls are headed, FIG. 12, but the heads are held captive between base plates 106 and the adjacent bars 111 until the wire elements 113 are detached from the studs 112. Once this is done, the parts separate freely and the pawls can be interchanged or different pawls can be added and the parts are very easy to reassemble. To prevent binding of the pivoted pawls between their mounting plates 111, spacer washers 114 are provided on the studs 112 between the mounting plates 111, FIG. 6.

The assembly 30 embodies a further feature which prevents a customer from retrieving his coin by use of the return push button 35 while the door 21 is being pulled open. A device to prevent this is under control of the access door latch 25 and is activated by the latch when the door 21 is completely closed, FIG. 6. That is to say, when the door 21 is closed with the latch 25, FIG. 6, the leading end of the latch within the recess 50 engages a crank plate 115 pivoted at 116 to one side of the center web 72 and swings this crank plate clockwise on its pivot to the position shown in FIG. 6. The crank plate 115 is connected to a shifter link 117 which extends generally vertically along one side of the web 72 and has its upper end connected to a lifter plate 118 whose top is adapted to engage and lift the extension 42 of pivoted bail 39 so that the latter is swung clear of the plunger 35 and the plunger is operable to release and return coins to a customer when the access door 21 is fully closed. FIG. 6 shows the plunger restricting bail 39 so elevated to release the plunger 35.

However, when the door 21 is being pulled open, as in FIG. 9, the latch 25 moves away from the crank plate 115 and the spring 41 pulls the bail 39 downwardly to its plungerblocking position in FIG. 9. Therefore, the coin release plunger 35 cannot be utilized when the dispenser access door is being pulled open. The described control linkage for the spring urged bail 39 working off of the latch 25 is very simple and positive and requires no adjustment once installed. A stationary stop lug 119 projecting from one side of the web 72 limits the travel of the lifter plate 118 in both directions.

A very efficient means is provided on the assembly 30 for changing the operation of the coin controlled mechanism from Sunday newspaper operation to daily operation, the latter arrangement being shown in FIG. 12. The means for accomplishing this changeover comprises a vertical slide 120 on the center vertical web 72 limited in its movement along this web by a cross pin 121, FIG. 5, received by a slot 122 in the web 72. The vertically movable slide 120, which is adjusted by hand, is equipped on opposite sides with pawl disabling or lock-out arms 123 such that when the slide 120 is raised on the web 72, the arms 123 will lift the counterweighted ends of particular coin gaging pawls 101 through 105 and swing these pawls to inoperable positions on their pivots. The slide 120 has plural vertically spaced openings 124 on its opposite sides, FIG. 2, for the attachment of the arms 123 at various elevations on the slide so that the lock-out arms can disable selected ones of the coin gaging pawls to meet the needs of particular newspaper pricing. The slide 120 is constantly biased downwardly by a spring 125 connected between the slide and the vertical web 72. When the slide is raised to change the assembly 30 over to Sunday newspaper operation, FIG. 12, so that the arms 123 will lift and disable selected ones of the pivoted pawls, as explained, the pivoted latch 126 on the vertical web 72 biased by a spring 127 and having a release handle 128 automatically moves under the lower end of the slide 120 and locks the slide in the elevated Sunday newspaper position. To return the slide downwardly for daily paper operation as shown in all of the other drawing figures, it is merely necessary to press the release handle 128 and turn the pivoted latch 126 against the spring 127, as shown in FIG. 12A, and the slide 120 will descend under influence of its spring 125.

In some instances not shown on the present drawings, the slide 120 can be raised by a key-operated member from outside of the housing 26, such member engaging another rigid arm of the slide 120, not shown, and lifting it to the position of FIG. 12.

In summation, therefore, the invention includes several key improvement features plus many other advantages as described. It includes a very unique access door latch 25 having a new mode of operation in that, when the access door 21 is closed, the latch 25 is cammed to a release or unlocked condition and the access door can be pulled open if proper coins have been deposited, but otherwise, the latch will swing upwardly and lock when an attempt to pull the access door open is made without proper coins being first deposited. This is a major departure from the prior art, as explained.

While conventional coin gaging pawls are employed on the mechanism assembly 30, their mounting in sandwiched relation between the plates 111 and their total adjustability on the slotted base plates 106 is very efficient and accurate. The double-ended wire securing elements 113 render rearrangement of pawls and assembling and disassembling of the pawl mounting means very simple.

In the assembly 30, the pivotal mounting of the coin tracks 78 and 79 on opposite sides of the vertical web 72 of T-cross section backbone 71 is unique and efficient, as is the utilization of the two extruded channel members 75 for the attachment of the principal parts of the assembly 30 to the backbone 71 with symmetry and in a very compact manner. Therefore, the unitized coin operated assembly 30 itself constitutes a major improvement feature.

Finally, the described improved mounting bracket 27 and its lower horizontal extension plate 29 with removable latch keeper pins 65 is another major improvement feature. The improved mounting bracket provides a secure and stable support and alignment means for the unitized assembly 30 enabling it to be quickly removed for adjustment or servicing and quickly replaced. Also, the mounting bracket coacts in a novel manner through its elements 63 and 68 to cam the pivoted latch 25 to its ready position, FIGS. 6 and 10, and to guide it laterally, as described.

The entire invention is more simplified, more compact, sturdier and more reliable in operation than the known prior art and manufacturing costs have been reduced in a number of areas by employing prepunched parts, easily replaceable parts and minimizing the number of adjustments while assuring that critical and necessary adjustments are available.

Another feature of the invention is that the primary latch 25 does not interlock with the coin mechanism assembly 30 but only with the replaceable pins 65 on the very sturdy mounting bracket 27. Also, when coins are being returned or refunded, the latch 25 does not move nor does the coin mechanism 30 move as is required in most of the prior art.

While the invention has been illustrated and described in terms of one particular cabinet arrangement, it should be understood that a variety of cabinet styles can be utilized for the invention. Neither is the invention limited to the disclosed semi-honor type of newspaper dispenser but is applicable to dispensers for newspapers, magazines and similar articles of the single vend type where one article is dispensed following the insertion of proper coins. Also, the improved latch construction and mode of operation is applicable to dispensers which employ lever actuators and the like in conjunction with a slide on which the latch is mounted, in lieu of the illustrated arrangement where the latch means is on a pivoted access door at the front of the cabinet.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In a coin operated newspaper vending machine, a main mounting bracket adapted for attachment to the interior of a coin mechanism housing wall, a unitized coin operated mechanism assembly, positioning and supporting means for said assembly on said main mounting bracket, a vending machine access door latch, means to pivotally mount said latch on the interior of a part of an access door, spring means biasing said latch upwardly relative to said main mounting bracket, lateral guide means for said latch on said mounting bracket, positive keeper means for the latch on said mounting bracket engageable within keeper opening means of the latch, cooperative camming parts on the mounting bracket and latch forcing said latch downwardly in opposition to the force of said spring means when the vending machine access door is closed, the latch then being held in a release position out of engagement with the positive keeper means on said mounting bracket, said main mounting bracket including a vertical plate body for attachment to said housing wall, a lower end horizontal plate extension projecting from said plate body and forming a base seat for said unitized coin operated mechanism assembly, a pair of side vertical positioning flanges for said mechanism assembly projecting from said plate body, a pair of pivoted keeper elements for said mechanism assembly on said plate body near the top thereof and adapted to releasably engage over a web of said mechanism assembly to retain the assembly releasably against said plate body, said positive keeper means for said latch comprising a pair of spaced keeper pins depending from said horizontal plate extension for entry into a pair of spaced openings in said latch near opposite sides of the latch, and replaceable mounting plates for said keeper pins fixed to the top of said horizontal plate extension and forming a positive retainer means for the lower end of said mechanism assembly so that the latter is positioned at the top and bottom and at both sides of the mounting bracket.

2. In a coin operated newspaper vending machine as defined in claim 1, and said coin operated mechanism assembly including a coin release and return system including a pivoted element, and a manual coin release plunger on said mounting bracket in operative alignment with said pivoted element.

3. In a coin operated newspaper vending machine as defined in claim 2, and a guide and support bracket for said plunger on said mounting bracket near the top of the mounting bracket, a spring connected with said plunger biasing it to a retracted non-use position, and a spring biased coin release plunger disabling element pivoted to said plunger guide and support bracket for cooperative relationship with an operating linkage on said mechanism assembly operated by said access door latch.

4. In a coin operated newspaper vending machine as defined in claim 1, and said mechanism assembly including a T-cross section body member including a center vertical web and a rear right angular web, the rear right angular web adapted to engage said vertical plate body and adapted to engage between said side vertical positioning flanges, the lower end of said T-cross section body member adapted to rest on said lower end horizontal plate extension of the mounting bracket.

5. In a coin operated newspaper vending machine, a main mounting bracket adapted for attachment to the interior of a coin mechanism housing wall, a unitized coin operated mechanism assembly, positioning and supporting means for said assembly on said main mounting bracket, a vending machine access door latch, means to pivotally mount said latch on the interior of a part of an access door, spring means biasing said latch upwardly relative to said main mounting bracket, lateral guide means for said latch on said mounting bracket, positive keeper means for the latch on said mounting bracket engageable within keeper opening means of the latch, cooperative camming parts on the mounting bracket and latch forcing said latch downwardly in opposition to the force of said spring means when the vending machine access door is closed, the latch then being held in a release position out of engagement with the positive keeper means on said mounting bracket, said access door latch comprising a channel-like rigid unitary member having a leading end flange forming one of said camming parts, the other camming part comprising a depending flange on said mounting bracket in the path of movement of said leading end flange, said leading end flange being inclined, said positive keeper means comprising a pair of spaced depending keeper pins on said mounting bracket, said latch having a pair of keeper pin slots formed therethrough near opposite sides thereof and rearwardly of said one camming part, said latch having a cut-out in its top wall between said slots, and a longitudinal bar section extending between the forward and rear edges of said cut-out and having at least its upper side curved transversely, whereby returned coins can slide around opposite sides of said bar section and can fall through said cut-out on opposite sides of said bar section, said bar section forming a rigid support for coins of proper denominations held against upward displacement in said mechanism assembly when said latch is in said release position.

6. In a coin operated newspaper vending machine, a main mounting bracket adapted for attachment to the interior of a coin mechanism housing wall, a unitized coin operated mechanism assembly, positioning and supporting means for said assembly on said main mounting bracket, a vending machine access door latch, means to pivotally mount said latch on the interior of a part of an access door, spring means biasing said latch upwardly relative to said main mounting bracket, lateral guide means for said latch on said mounting bracket, positive keeper means for the latch on said mounting bracket engageable within keeper opening means of the latch, cooperative camming parts on the mounting bracket and latch forcing said latch downwardly in opposition to the force of said spring means when the vending machine access door is closed, the latch then being held in a release position out of engagement with the positive keeper means on said mounting bracket, and said positioning and supporting means including a vertical plate body portion and a bottom horizontal extension plate on said main mounting bracket, said unitized coin operated mechanism assembly including a vertical T-cross section body member having a center vertical web and a rear vertical web at right angles to said center web and extending beyond opposite sides of the center web substantially equidistantly, said rear vertical web lying against said vertical plate body portion and the bottom of the vertical T-cross section body member resting on said bottom horizontal extension plate.

7. In a coin operated newspaper vending machine as defined in claim 6, and said coin operated mechanism assembly additionally comprising a pair of side parallel longitudinal channel members fixed to said rear web on opposite sides of said center vertical web, a pair of coin tracks hingedly connected with said channel members and being on opposite sides of said center web and defining with the center web a pair of vertical coin passages for coins of different denominations on opposite sides of the center web, coin gaging pawl assemblies mounted on said side channel members laterally outwardly of said coin tracks, and a pivoted member on said center vertical web near the top thereof and operatively connected with the hinged coin tracks to spread them apart for releasing coins therein, said pivoted member adapted to be operated by a coin release plunger means on said mounting bracket, and spring means biasing said coin tracks toward parallel opposing relationship in engagement with opposite faces of said center vertical web.

8. In a coin operated newspaper vending machine as defined in claim 7, and selected pawl disabling slide means on said center vertical web including projecting arms adapted to elevate counterweight extensions of the coin gaging pawls on said pawl assemblies.

9. In a coin operated newspaper vending machine as defined in claim 8, and a coin release plunger disabling linkage on said center vertical web including a pivoted crank part in the path of movement of said access door latch.

10. In a coin operated newspaper vending machine as defined in claim 7, and said coin gaging pawl assemblies each comprising a slotted base plate, bolt means adjustably securing the slotted base plate to one of said side channel members, a pair of superposed apertured pawl mounting plates on each base plate, mounting studs on the ends of each base plate projecting through mounting apertures near opposite ends of said pawl mounting plates, pawl pivot pins extending through selected registering apertures of the pawl mounting plates and having heads arranged captively between the base plate and the adjacent pawl mounting plate, counterweighted pawls freely pivotally mounted on said pawl pivot pins and being disposed sandwich-like between the pawl mounting plates, and quick release fastener means for fastening the pawl mounting plates to said mounting studs.

11. In a coin operated newspaper vending machine as defined in claim 10, and said quick release fastener means comprising double-ended elongated yielding wire fastener elements having end terminals engageable through apertures in said mounting studs.

12. In a coin operated newspaper vending machine as defined in claim 7, and said pivoted member being a wishbone-like member having spaced lower end camming parts, and divergent wing extensions projecting from said coin tracks and having sliding camming engagement with said camming parts of the wishbone-like member, and a spring connected with the wishbone-like member and biasing it on its pivot in a direction to promote closing of said coin tracks against opposite sides of said center vertical web.

13. A coin operated mechanism for use in conjunction with a mounting bracket and a coacting access door mounted latch on a vending machine, said assembly comprising a T-cross section body member including a center web projecting forwardly of a rear right angular web, a pair of laterally spaced parallel channel members fixedly secured to one side of said rear web on opposite sides of said center web and having longitudinal hinge elements, spaced opposing coin tracks on opposite sides of said center web including knuckles rotatably engaging said hinge elements, said coin tracks having open sides facing said center web and forming therewith a pair of longitudinal passages for coins of different denominations, base plates adjustably mounted on said channel members and spaced laterally outwardly of said coin tracks, pairs of superposed pawl mounting plates of releasably secured to said base plates and extending longitudinally thereof and being bodily adjustable therewith, quick release fastener means joining the pairs of pawl mounting plates to the base plates, coin gaging pawls pivotally mounted in sandwiched relationship between said pawl mounting plates, said pawl mounting plates having preformed accurately spaced pivot openings, pawl pivot pins engaged selectively with registering pairs of said pivot openings and having heads arranged captively between the base plates and adjacent pawl mounting plates.

14. A coin operated mechanism as defined in claim 13, and said channel members and said coin tracks comprising extruded elements.

15. A coin operated mechanism as defined in claim 13, and pivoted camming means on said center web operatively engaging said coin tracks to move the same to separated positions away from said center web to release coins from said longitudinal passages.

16. A coin operated mechanism as defined in claim 15, and a slide member on said center web and movable longitudinally thereon, means to restrain and limit the movement of said slide member on said center web, and spaced arms projecting from said slide member and adapted to engage counterweighted pivoted pawls of said mechanism to disable preselected pawls.

* * * * *